United States Patent [19]

Ahlgren

[11] Patent Number: 4,528,763

[45] Date of Patent: Jul. 16, 1985

[54] SIGN HAVING CHANGEABLE DISPLAYS

[76] Inventor: Stig B. Ahlgren, Korpralgatan 7, Malmö, Sweden

[21] Appl. No.: 571,494

[22] Filed: Jan. 17, 1984

[30] Foreign Application Priority Data

Jan. 27, 1983 [SE] Sweden ..... 8300409

[51] Int. Cl.[3] ..... G09F 11/02

[52] U.S. Cl. ..... 40/505; 40/503; 40/506

[58] Field of Search ..... 40/503, 505, 506

[56] References Cited

U.S. PATENT DOCUMENTS

| | | | |
|---|---|---|---|
| 3,304,638 | 2/1967 | Grandell et al. | 40/505 |
| 3,387,394 | 6/1968 | Werner | 40/505 |
| 3,798,811 | 3/1974 | Rockola | 40/505 |
| 3,826,027 | 7/1974 | Abbema | 40/505 |
| 3,921,321 | 11/1975 | Weisskopf | 40/505 |
| 4,002,022 | 1/1977 | Lopez | 40/505 |

FOREIGN PATENT DOCUMENTS

| | | | |
|---|---|---|---|
| 639830 | 11/1963 | Belgium | 40/505 |
| 1600001 | 8/1970 | France . | |
| 681717 | 1/1955 | Italy | 40/505 |
| 1377514 | 7/1974 | United Kingdom . | |
| 1374657 | 9/1974 | United Kingdom . | |
| 1470785 | 4/1977 | United Kingdom . | |
| 2105895 | 3/1983 | United Kingdom . | |

*Primary Examiner*—John J. Wilson
*Assistant Examiner*—Cary E. Stone
*Attorney, Agent, or Firm*—Bacon & Thomas

[57] ABSTRACT

A sign formed from plural trilateral display screen assemblies, each assembly being rotatable to dispose one of three screen sides in a forward position, wherein all corresponding screen sides in such forward position collectively defining and displaying a picture.

8 Claims, 8 Drawing Figures

SIGN HAVING CHANGEABLE DISPLAYS

This invention relates to signs having trilateral display screens, in which a number of adjacent screen sides (5, 6, 7) can form a picture which can be caused to change over into a second or a third picture by rotation of the display screens (4).

Trilateral display screens of the type indicated comprise elongate hollow profile members of triangular cross section. Each side of such a hollow profile member is provided with parts of a picture that is obtained when all such sides are turned outwardly at the same time.

When a picture is to be changed over into another picture one has to glue every new part thereof to the sides of the display screens. This is time-consuming and in many respects a complicated procedure.

The present invention is aimed at the elimination of this problem. This is realized according to the invention mainly in that the type of sign outlined above has been given the characteristic features defined by the appendant claims.

Applying these characteristic features, the change of pictures is greatly facilitated and a simple sign arrangement is obtained, which comprises but a small number of parts.

The invention will be described in greater detail below with reference to the accompanying drawings, in which.

Figure 1:
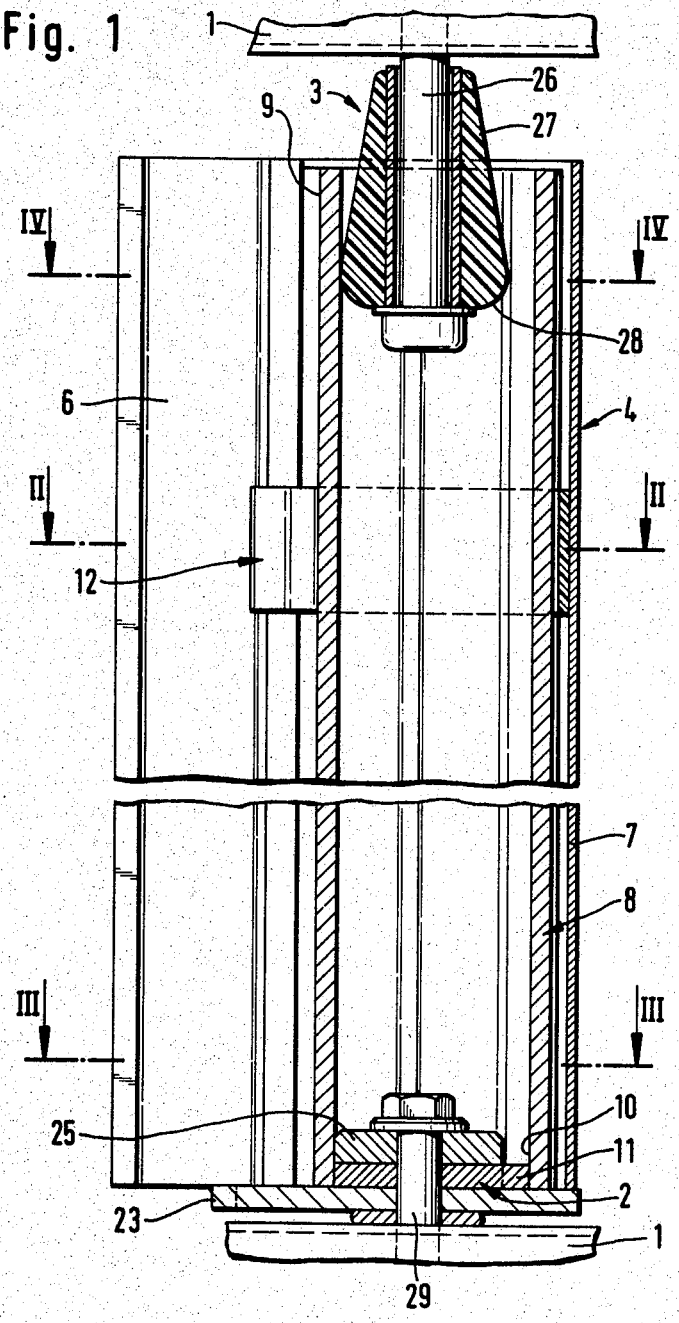
FIG. 1 shows a side view of a display screen provided with an arrangement according to the invention.
Figure 2:
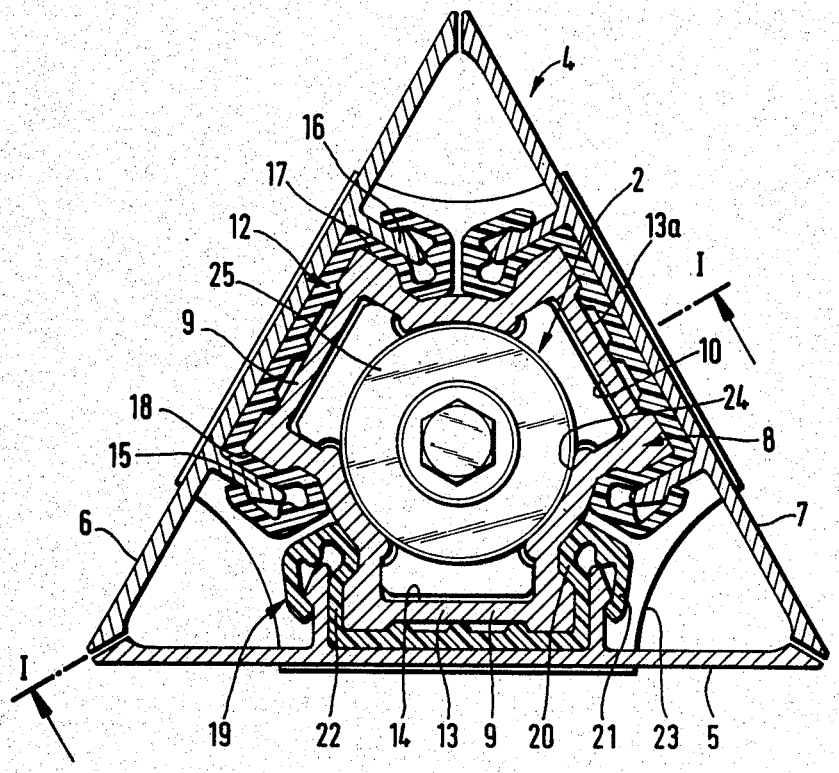
FIG. 2 is a section on line II—II in FIG. 1.
Figure 3:
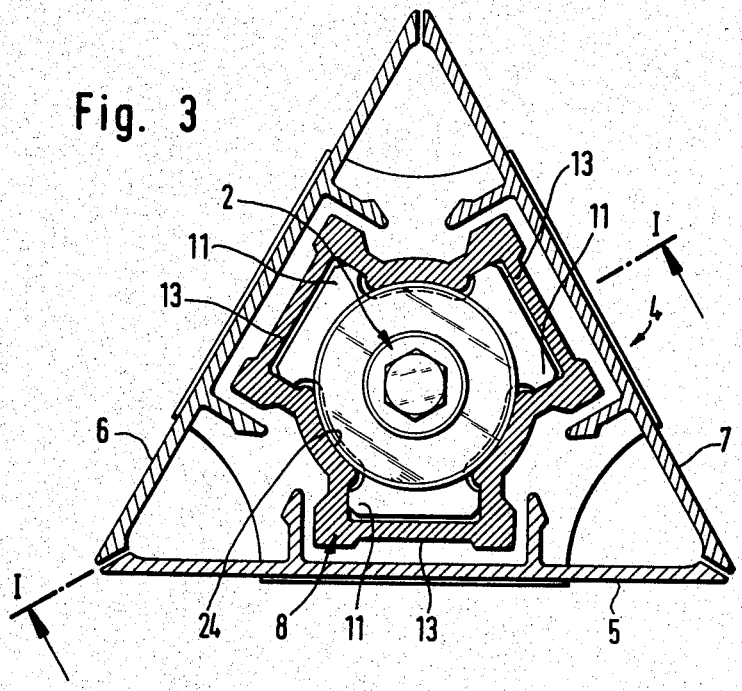
FIG. 3 is a section on line III—III in FIG. 1.
Figure 4:
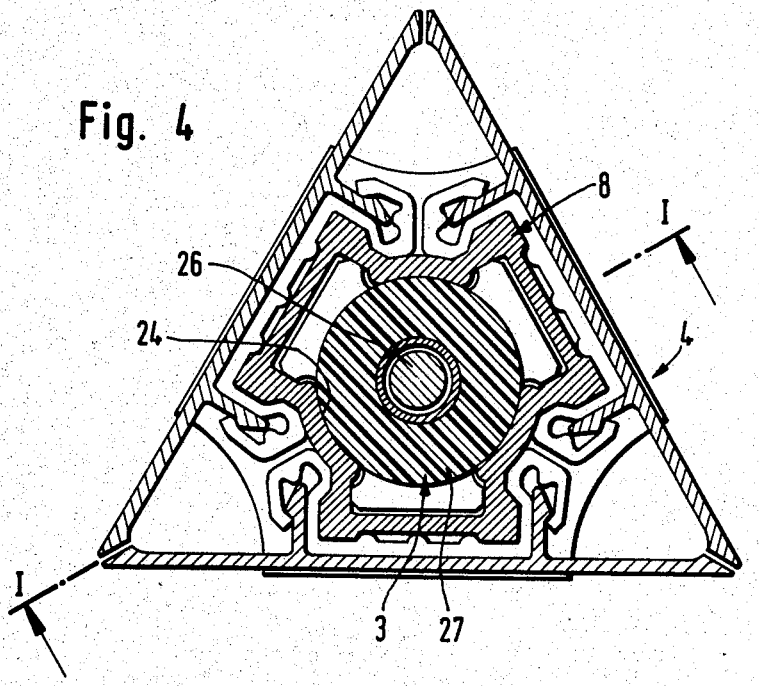
FIG. 4 is a section on line IV—IV in FIG. 1.
Figure 7:
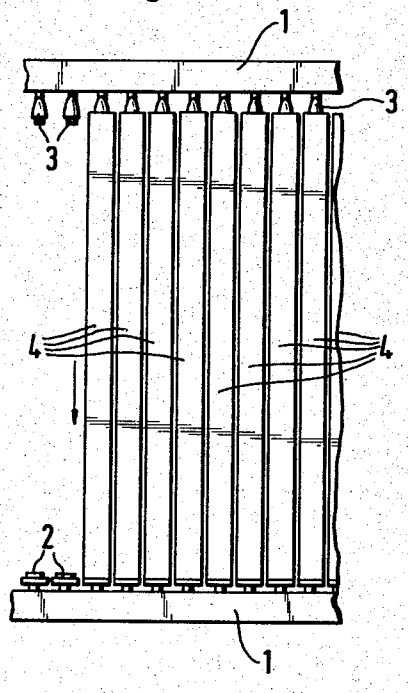
FIGS. 5 to 7 show various mounting stages.

The sign illustrated in the drawings comprises a frame 1 which has a number of driven dogs 2 at the bottom and a corresponding number of holders 3 at the top. Each dog 2 and the corresponding holder 3 are adapted to support a trilateral display screen 4. The dogs 2 are further adapted to rotate the display screen 4 until one of its screen sides 5, 6 or 7 is facing forwardly, whereupon they rotate the display screen 4 until another screen side is facing forwardly, and so on.

To permit exchanging one or more picture portions of each display screen 4 without having to perform comprehensive gluing work outdoors under perhaps difficult conditions, the display screens 4 consist of a body 8 having three anchorage portions 9 for mounting the screen sides 5, 6, 7 directly to the body 8 or by the intermediary of holders 12, or for dismounting said screen sides therefrom. This implies that one, two or all three screen sides can be replaced by one, two or three screen sides for one or more other pictures of different appearance from the original ones. The change of pictures can be performed rapidly by simple motions, and removed screen sides can be put by for reuse. Alternatively, said removed screen sides can be provided with parts of new pictures whenever desired and this can be done in suitable environment while the new sign is in full operation. With a series of bodies 8 and a suitable number of screen sides 5, 6, 7, the pictures of the sign can be replaced by other pictures very rapidly and at low expenditure of work.

To provide a simple and otherwise expedient body 8 the anchorage portions 9 internally form dog means 10 which are adapted to constitute entraining studs 11 so that the display screen 4 partakes in the rotation of the dog 2.

To facilitate mounting, the anchorage portion 9 is formed by a radially protruding part 13 to which the screen sides 5, 6 or 7 or the holders 12 can be fastened by snap action. Said part 13 has an outer side 13*a* against which the display screen is adapted to bear directly or by the intermediary of the holder 12, said outer side being directed such that the screen side 5 and/or 6 and/or 7 will take up a predetermined position relative to the other screen sides.

The inner side 14 of the radially protruding part 13 forms a recess for an entraining stud 11 of the dog 2. The radially protruding part 13 of the body 8 constitutes outer edges 17, 18, inside of which the screen side can engage by snap action.

The holder 12 preferably consists of plastics and has two resilient portions 19, 20 for retaining the holder by snap action to the body 8. Each resilient portion 19, 20 has double arms 21, 22 between which ribs 15, 16 or the like on the display screen can engage by snap action.

To safeguard a simple design of the screen sides and reinforce them at the same time, said screen sides are provided with two longitudinal ribs 15, 16 which can engage the body 8 by snap action. Said ribs 15, 16 permit fixation of the display screen directly to the body or by the intermediary of the holders, by way of snap action.

To ensure that the display screens do not slide along the body 8 after being mounted in position, the dog 2 is provided with abutment and/or supporting means 23. Said abutment and/or supporting means 23 permit the provision of direct surfaces of engagement for the display screens in signs having vertically directed display screens.

For rapid application of the display screens to the dog 2 and the upper holder 3 the body 8 has a circular portion 24 which conforms to the upper holder 3 and to a circular portion 25 of the dog 2.

Satisfactory rigidity is imparted to the body 8 in that both the radially protruding parts 13 and the circular portions 24 extend along the entire body.

Figure 6:
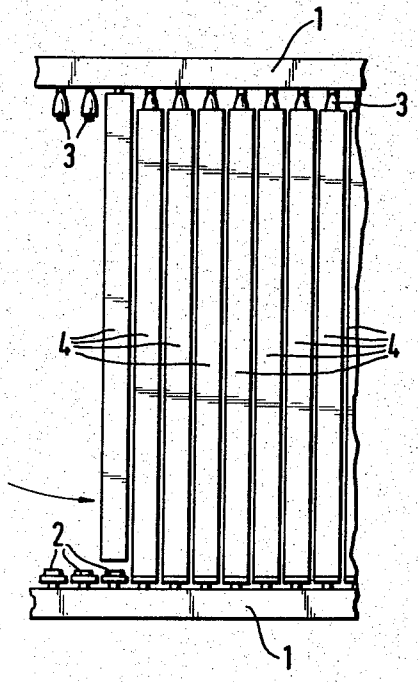
Figure 5:
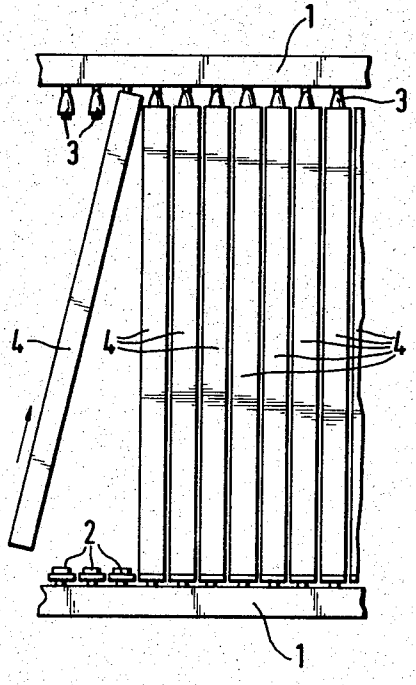
Figure 8:
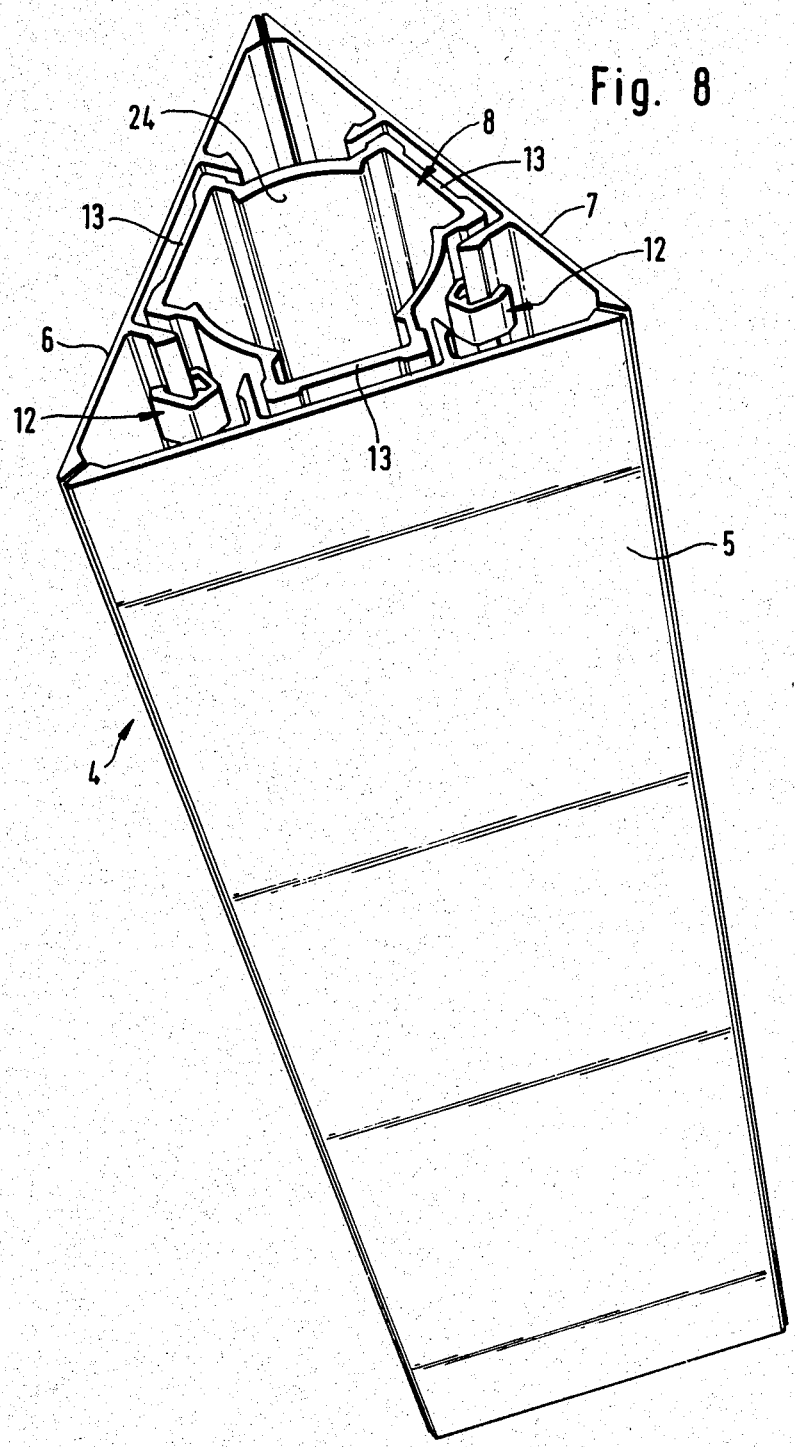
FIG. 8 is a perspective view of a display screen.

The upper display screen holder 3 comprises a stub shaft 26 mounted in the frame 1, and an outer portion 27 arranged on said stub shaft for vertical movement. Said outer portion preferably is cylindrical and is made of plastics or rubber material. The outer portion 27 preferably increases in thickness in a downward direction and has a rounded lower end edge 28. As a result, the display screen is more easily passed onto the outer portion, as seen in FIG. 5, whereupon it can be moved into vertical position as seen in FIG. 6, and finally passed from above onto the circular portion 25 of the dog.

It may finally be mentioned that the dog 2 is driven with the aid of a conventional drive via a drive shaft 29.

The invention should not be considered limited to the embodiment illustrated in the drawings, as it permits being varied within the scope of the appendant claims. Thus, but one or two display screens can be removably mounted on the body, and mounting and dismounting may be performed in a manner other than by snap-action fixation and by pulling, respectively. The number of holders for the display screens may vary depending upon the length of the body, and said holders may be dispensed with altogether. The design of the body, the dog and the upper holder may be varied without departing from the invention.

I claim:

1. An improved sign formed from a plurality of trilateral display screen assemblies wherein each assembly comprises:

(a) an elongate body having a substantially uniform transverse cross-sectional configuration defined in part by a plurality of radially extending anchorage portions;

(b) a screen of elongate configuration and including a pair of spaced longitudinal ribs associated with each anchorage portion;

(c) each anchorage portion including a holder having two pairs of resilient arms for detachably mounting a corresponding screen side to the anchorage portion, wherein each longitudinal rib of the screen side is detachably snap-fitted between each pair of arms; and (d) means for rotating the body to position each screen side into a forwardly facing position.

2. The sign of claim 1 wherein the means for rotating the body includes a driven dog member engageable with one end of the body.

3. The sign of claim 2 wherein:

(a) each anchorage portion includes a recess; and (b) the dog member includes a plurality of studs engageable within the recesses of the anchorage portions.

4. The sign of claim 3 wherein:

(a) the dog member includes a circular portion, with the studs being directed radially outwardly from the circular portion; and (b) the end of the body engageable by the dog member further includes a circular configuration corresponding to the configuration of the circular portion of the dog member for receiving same.

5. The sign of claim 4 further including means associated with the dog member for supporting the screen sides and preventing the sliding of same along the body.

6. The sign of claim 2 wherein the means for rotating the body further includes a substantially cylindrical holder engageable with the other end of the body.

7. The sign of claim 6 wherein the cylindrical holder is supported for displacement and includes a free end having a substantially rounded-off end edge.

8. The sign of claim 6 wherein the cylindrical holder is formed of resilient material having a substantially tapered configuration for facilitating engagement and manipulation of the body.

* * * * *